US009537218B2

(12) United States Patent
Lin et al.

(10) Patent No.: US 9,537,218 B2
(45) Date of Patent: Jan. 3, 2017

(54) BROADBAND ANTENNA AND WIRELESS COMMUNICATION DEVICE EMPLOYING SAME

(71) Applicant: Chiun Mai Communication Systems, Inc., New Taipei (TW)

(72) Inventors: Yen-Hui Lin, New Taipei (TW); Geng-Hong Liou, New Taipei (TW)

(73) Assignee: Chiun Mai Communication Systems, Inc., New Tapiei (TW)

( * ) Notice: Subject to any disclaimer, the term of this patent is extended or adjusted under 35 U.S.C. 154(b) by 267 days.

(21) Appl. No.: 14/306,481

(22) Filed: Jun. 17, 2014

(65) Prior Publication Data

US 2014/0375507 A1 Dec. 25, 2014

(30) Foreign Application Priority Data

Jun. 19, 2013 (TW) ..... 102121645 A

(51) Int. Cl.

| | |
|---|---|
| ***H01Q 5/00*** | (2015.01) |
| ***H01Q 5/378*** | (2015.01) |
| ***H01Q 1/36*** | (2006.01) |
| ***H01Q 21/28*** | (2006.01) |
| ***H01Q 5/371*** | (2015.01) |
| *H01Q 1/24* | (2006.01) |

(52) U.S. Cl.

CPC ..... *H01Q 5/378* (2015.01); *H01Q 1/36* (2013.01); *H01Q 5/371* (2015.01); *H01Q 21/28* (2013.01); *H01Q 1/241* (2013.01)

(58) Field of Classification Search

CPC ..... H01Q 1/36; H01Q 5/371; H01Q 5/378

See application file for complete search history.

(56) References Cited

U.S. PATENT DOCUMENTS

| | | | | |
|---|---|---|---|---|
| 9,035,830 | B2 * | 5/2015 | Komulainen | H01Q 1/521 343/700 MS |
| 2013/0122828 | A1 * | 5/2013 | Choi | H04B 1/3827 455/77 |

OTHER PUBLICATIONS

Antenna Theory: A Review, Balanis, Proc. IEEE vol. 80 No. 1 Jan. 1992.*

* cited by examiner

*Primary Examiner* — Sue A Purvis
*Assistant Examiner* — Amal Patel
(74) *Attorney, Agent, or Firm* — Zhigang Ma

(57) ABSTRACT

A broadband antenna for a wireless communication device includes a first feeding portion, a second feeding portion, a grounding portion, a low band radiating unit, a high band radiating unit, and a resonating unit. The low band radiating unit is connected to the first feeding portion and establishing a first current path to generate a low band frequency. The high band radiating unit is connected to the second feeding portion and establishing a second current path to generate a first high band frequency. The resonating unit is connected to the grounding portion and establishing a third current path to generate a second high band frequency. The resonating unit resonates with the high band radiating unit to generate a third high band frequency.

16 Claims, 6 Drawing Sheets

BROADBAND ANTENNA AND WIRELESS COMMUNICATION DEVICE EMPLOYING SAME

FIELD

The exemplary disclosure generally relates to antennas, and particularly to a broadband antenna and a wireless communication device employing the same.

BACKGROUND

With improvements in the integration of wireless communication systems, broadband antennas have become increasingly important. For a wireless communication device to utilize various frequency bandwidths, antennas having wider bandwidths have become a significant technology.

BRIEF DESCRIPTION OF THE DRAWINGS

Many aspects of the exemplary embodiments can be better understood with reference to the drawings. The components in the drawings are not necessarily drawn to scale, the emphasis instead being placed upon clearly illustrating the principles of the disclosure.

DETAILED DESCRIPTION

The disclosure is illustrated by way of example and not by way of limitation in the figures of the accompanying drawings in which like references indicate similar elements. It should be noted that references to "an" or "one" exemplary embodiment in this disclosure are not necessarily to the same exemplary embodiment, and such references mean "at least one." The references "a plurality of" and "a number of" mean "at least two."

In the following disclosure the term "coupled" is defined as connected, whether directly or indirectly by intervening components, and is not necessarily limited to physical connections. The connection can be such that the objects are permanently connected or releasably connected.

Figure 1:
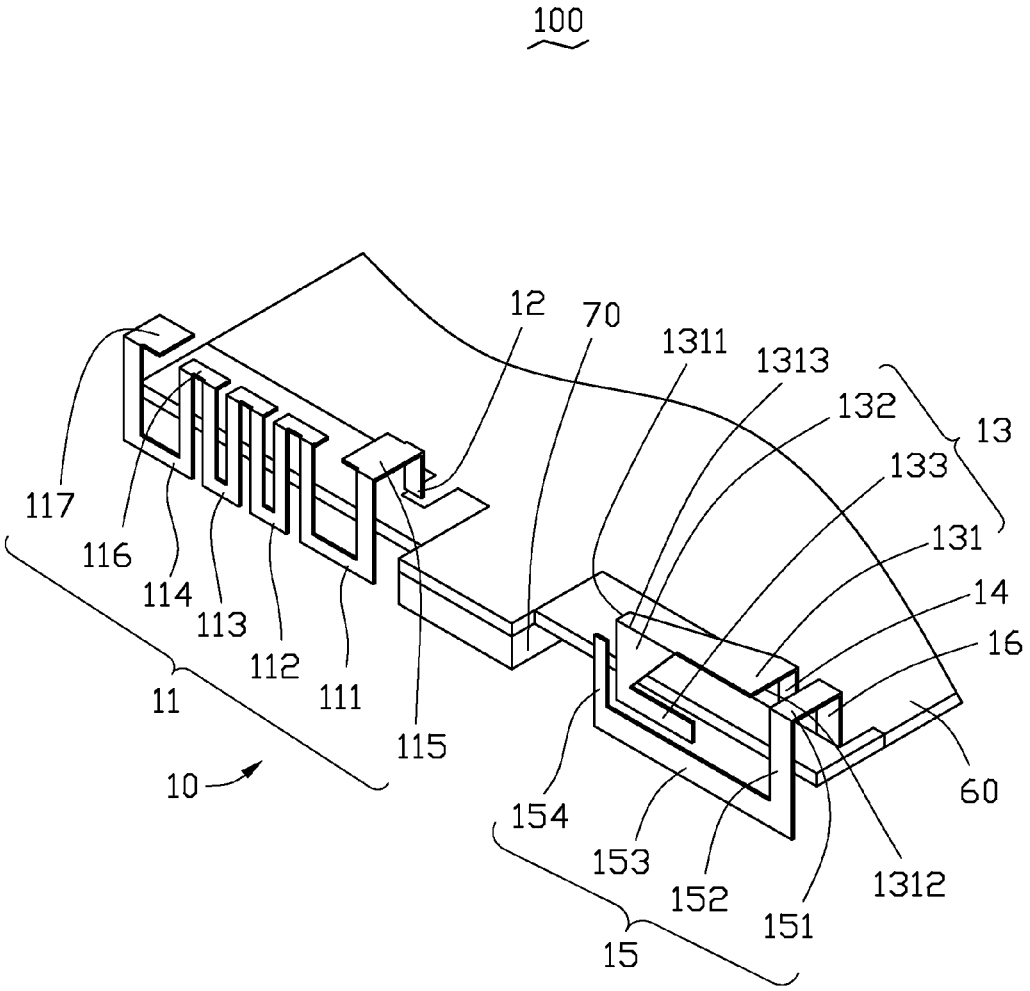
FIG. 1 is a schematic view of a first exemplary embodiment of a wireless communication device employing a broadband antenna.

FIG. 1 illustrates a schematic view of a first exemplary embodiment of a wireless communication device 100 including a broadband antenna 10. As shown in FIG. 1, the wireless communication device 100 further includes a printed circuit board (PCB) 60 and a universal serial bus (USB) connector 70. The broadband antenna 10 is coupled to the PCB 60. The USB connector 70 is mounted on and electronically connected to the PCB 60.

The broadband antenna 10 includes a low band radiating unit 11, a first feeding portion 12, a high band radiating unit 13, a second feeding portion 14, a resonating unit 15, and a grounding portion 16. The low band radiating unit 11 is positioned at and spaced apart from a first edge of the USB connector 70, and the high band radiating unit 13 is positioned at and spaced apart from a second edge of the USB connector 70. Thus, a radiating performance of the broadband antenna 10 can be prevented from interference by the USB connector 70.

The low band radiating unit 11 is a meandering monopole antenna, and includes a first radiator 111, a second radiator 112, a third radiator 113, a fourth radiator 114, a fifth radiator 117, a first connecting strip 115, and three second connecting strips 116. The first, second, third and fourth radiators 111, 112, 113 and 114 are substantially coplanar with each other, and are connected in sequence by the three second connecting strips 116. In the illustrated exemplary embodiment, each of the first, second, third, and fourth radiators 111, 112, 113, and 114 is a substantially U-shaped strips. The second radiator 112 has a substantially same shape and size as the third radiator 113. The fifth radiator 117, the first connecting strip 115, and the three second connecting strips 116 are positioned in a plane that is substantially perpendicular to a plane in which the first, second, third, and fourth radiators 111, 112, 113, and 114 are positioned. The fifth radiator 117 substantially perpendicularly extends from a distal end of the fourth radiator 114. The first connecting strip 115 is substantially a rectangular strip, and is connected between a distal end of the first radiator 111 and the first feeding portion 12. The three second connecting strips 116 are substantially collinear with each other.

In one exemplary embodiment, distances between the first radiator 111 and the second radiator 112, the second radiator 112 and the third radiator 113, and the third radiator 113 and the fourth radiator 114 are about 1 millimeter (mm). Each of the first, second, third, and fourth radiators 111, 112, 113, and 114 includes two substantially parallel arms. In an exemplary embodiment, a distance between the two parallel arms of the first radiator 111 is about 3.9 mm, a distance between the two parallel arms of the second radiator 112 is about 1 mm, a distance between the two parallel arms of the third radiator 113 is about 1 mm, and a distance between the two parallel arms of the fourth radiator 114 is about 3.4 mm. In an exemplary embodiment, a length of the two parallel arms of each of the first, second, third, and fourth radiators 111, 112, 113, and 114 is about 8 mm.

The first feeding portion 12 is a substantially rectangular strip that substantially perpendicularly extends from an end of the first connecting strip 115 of the low band radiating unit 11. The first feeding portion 12 is positioned in a plane that is substantially parallel to a plane in which the first, second, third, and fourth radiators 111, 112, 113, and 114 are positioned. The first feeding portion 12 is coupled to the PCB 60 via a first conventional impedance matching circuit (not shown).

The high band radiating unit 13 is a monopole antenna and includes a first radiating portion 131, a second radiating portion 132, and a third radiating portion 133. The first radiating portion 131 is a substantially right trapezoidal strip. The first radiating portion 131 includes a first edge 1311, a second edge 1312, and a third edge 1313. The second edge 1312 is substantially parallel to and longer than the first edge 1311, and the third edge 1313 is substantially perpendicularly connected between the first edge 1311 and the second edge 1312. In one exemplary embodiment, a length of the first edge 1311 is about 1.2 mm, and a length of the second edge 1312 is about 4.2 mm. The second radiating portion 132 is substantially a right trapezoidal strip that extends substantially perpendicularly from the third edge 1313 of the first radiating portion 131. The third radiating portion 133 is a substantially rectangular strip connected to an end of the second radiating portion 132 opposite to the first radiating portion 131. In one exemplary embodiment, a length of a first edge of the second radiating portion 132 connected to the first radiating portion 131 is about 5.2 mm, and a length of a second edge of the second radiating portion 132 connected to the third radiating portion 133 is about 1.2 mm.

The second feeding portion 14 is a substantially rectangular strip that substantially perpendicularly extends from a fourth edge (not labeled) of the first radiating portion 131 opposite to the third edge 1313. The second feeding portion 14 is positioned in a plane that is substantially perpendicular to a plane in which the first radiating portion 131 is positioned. The second feeding portion 14 is coupled to the PCB 60 via a second conventional impedance matching circuit (not shown).

The resonating unit 15 is spaced apart from and partially surrounds the high band resonating unit 13. The resonating unit 15 includes a first resonating arm 151, a second resonating arm 152, a third resonating arm 153, and a fourth resonating arm 154. The first resonating arm 151 is a substantially rectangular strip and substantially parallel to and spaced from the second edge 1312 of the first resonating arm 131. The first resonating arm 151 is substantially coplanar with the first radiating portion 131. The first resonating arm 151 is substantially parallel to and spaced apart from the second edge 1312 of the first radiating portion 131. The second, third, and fourth resonating arms 152, 153, and 154 are substantially coplanar with the second and third radiating portions 132 and 133, and cooperatively define a receiving space (not labeled). The third resonating arm 153 is substantially parallel to and spaced apart from the third radiating portion 133. The second and third radiating portions 132 and 133 are received in the receiving space. In one exemplary embodiment, a distance between the first resonating arm 151 and the second edge 1312 of the first radiating portion 131 is about 1.9 mm, a distance between the third resonating arm 153 and the third radiating portion 133 is about 1 mm, and a total length of the second, third, and fourth resonating arms 152, 153, and 154 is about 33.5 mm.

The grounding portion 16 is a substantially rectangular strip and substantially coplanar with and substantially parallel to the second feeding portion 14. The grounding portion 16 substantially perpendicularly extends from an end of the first resonating arm 151 opposite to the second resonating arm 152. The grounding portion 16 is coupled to the PCB 60 and grounded via the PCB 60.

In use, a first current path is established in the low band radiating unit 11 to generate a low band frequency to receive/send wireless signals from about 700 megahertz (MHz) to about 960 MHz. A second current path is established in the high band radiating unit 13 to generate a first high band frequency. A third current path is established in the resonating unit 15 to generate a second high band frequency. In addition, the resonating unit 15 resonates with the high band radiating unit 13 to cooperatively generate a third high band frequency, such that the broadband antenna 10 can receive/send high-frequency wireless signals from about 1400 MHz to about 3000 MHz. Accordingly, the wireless communication device 100 employing the broadband antenna 10 can be used in common wireless communication systems, such as LTE Band 13/17 (700 MHz), GSM (850/900 MHz), GSM (1800-1900 MHz), WCDMA (2100 MHz), LTE Band 1 (2100 MHz), and LTE Band 7 (2600 MHz), with exceptional communication quality.

Figure 2:
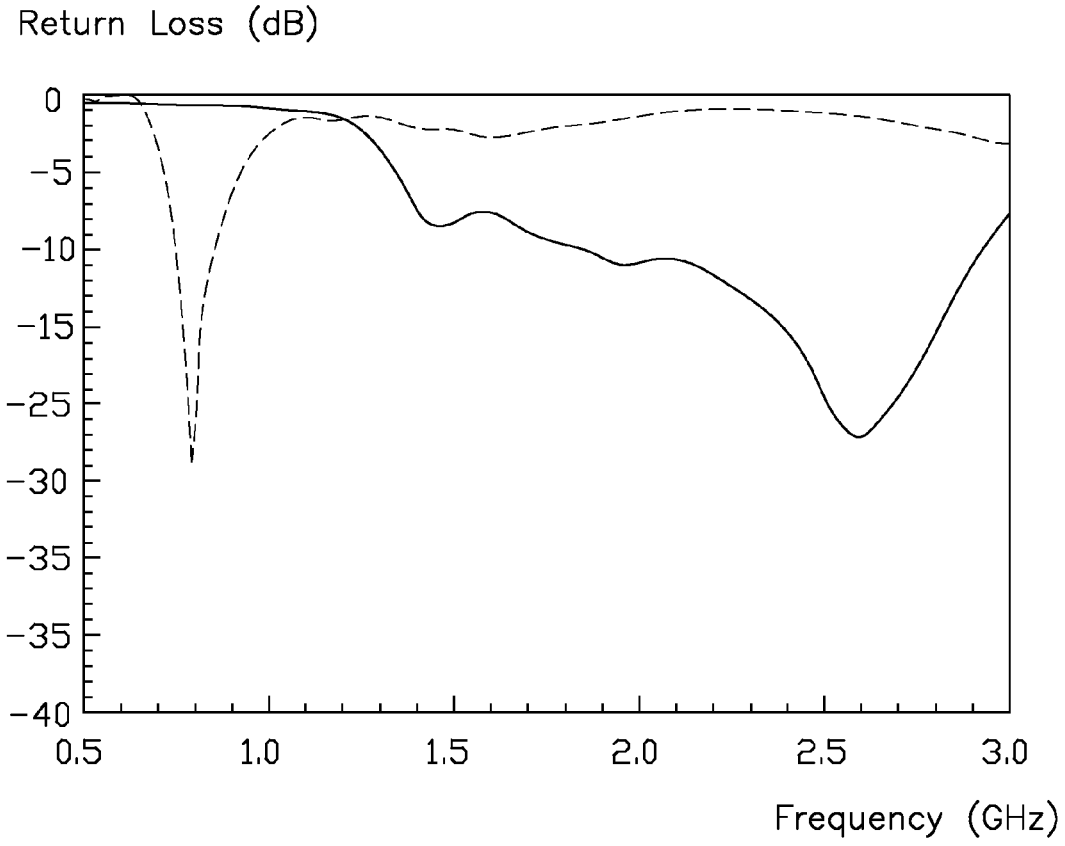
FIG. 2 is a diagram showing return loss (RL) measurements of the broadband antenna shown in FIG. 1.

FIG. 2 illustrates a diagram showing a return loss (RL) measurement of the broadband antenna 10 shown in FIG. 1. A broken line curve represents RL of the low band radiating unit 11 of the broadband antenna 10, and a solid curve represents RL of the high band radiating unit 13 of the broadband antenna 10. As shown in FIG. 2, the RL of the broadband antenna 10 is less than −6 dB when the broadband antenna 10 receives/sends wireless signals at frequencies from about 700 MHz to about 960 MHz, and from about 1400 MHz to about 3000 MHz. Accordingly, the broadband antenna 10 can be used in common wireless communication systems, such as LTE Band 13/17 (700 MHz), GSM (850/900 MHz), GSM (1800-1900 MHz), WCDMA (2100 MHz), LTE Band 1 (2100 MHz), and LTE Band 7 (2600 MHz), with exceptional communication quality.

Figure 3:
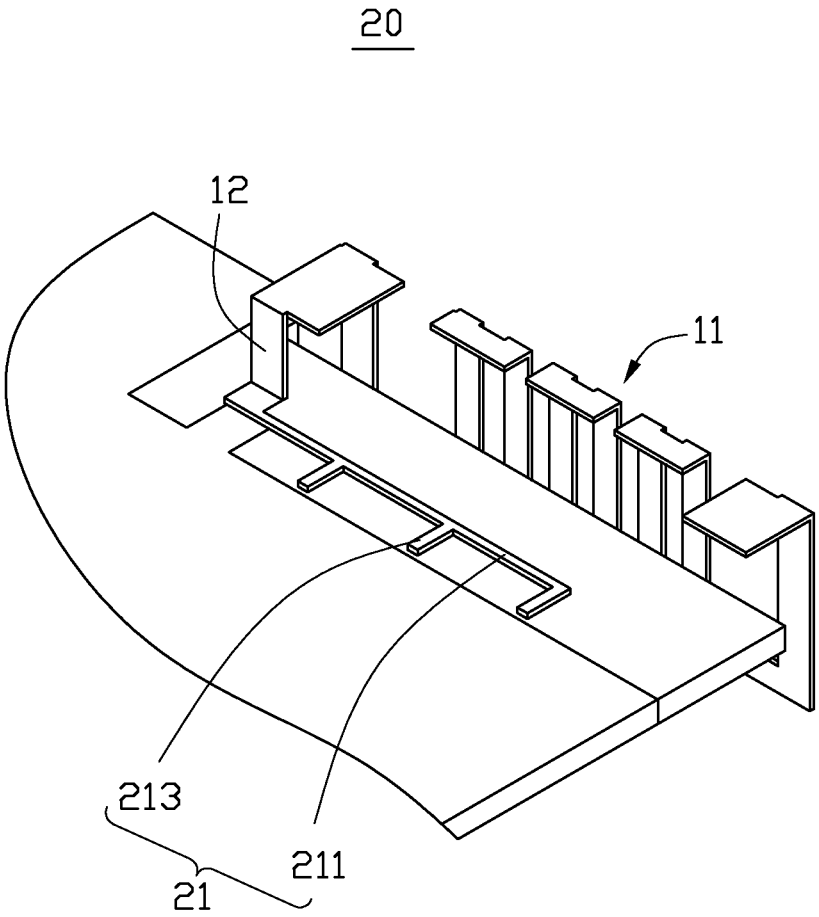
FIG. 3 is a schematic view of a second exemplary embodiment of a broadband antenna of the wireless communication device.

FIG. 3 illustrates a second exemplary embodiment of a broadband antenna 20 of the wireless communication device 100. The broadband antenna 20 has a substantially same shape and size as the broadband antenna 10, except that the broadband antenna 20 further includes an impedance matching switch structure 21 connected between the first feeding portion 12 and a third conventional impedance matching circuit (not shown). The impedance matching switch structure 21 is located on the PCB 60 and grounded. The impedance matching switch 21 includes a main strip 211 and three grounding strips 213. The three grounding strips 213 are spaced from each other and substantially perpendicularly connected to one edge of the main strip 211. A first end portion of the main strip 211 is connected to the first feeding portion 12, and a second end portion of the main strip 211 is connected to one of the three grounding strips 213. A junction between the main strip 211 and the first feeding portion 12 is coupled to the third impedance matching circuit, one of the grounding strips 213 is selected to be grounded to adjust a grounding path of the third impedance matching circuit, thereby adjusting the frequency band of the low band radiating unit 11 of the broadband antenna 20.

Figure 4:
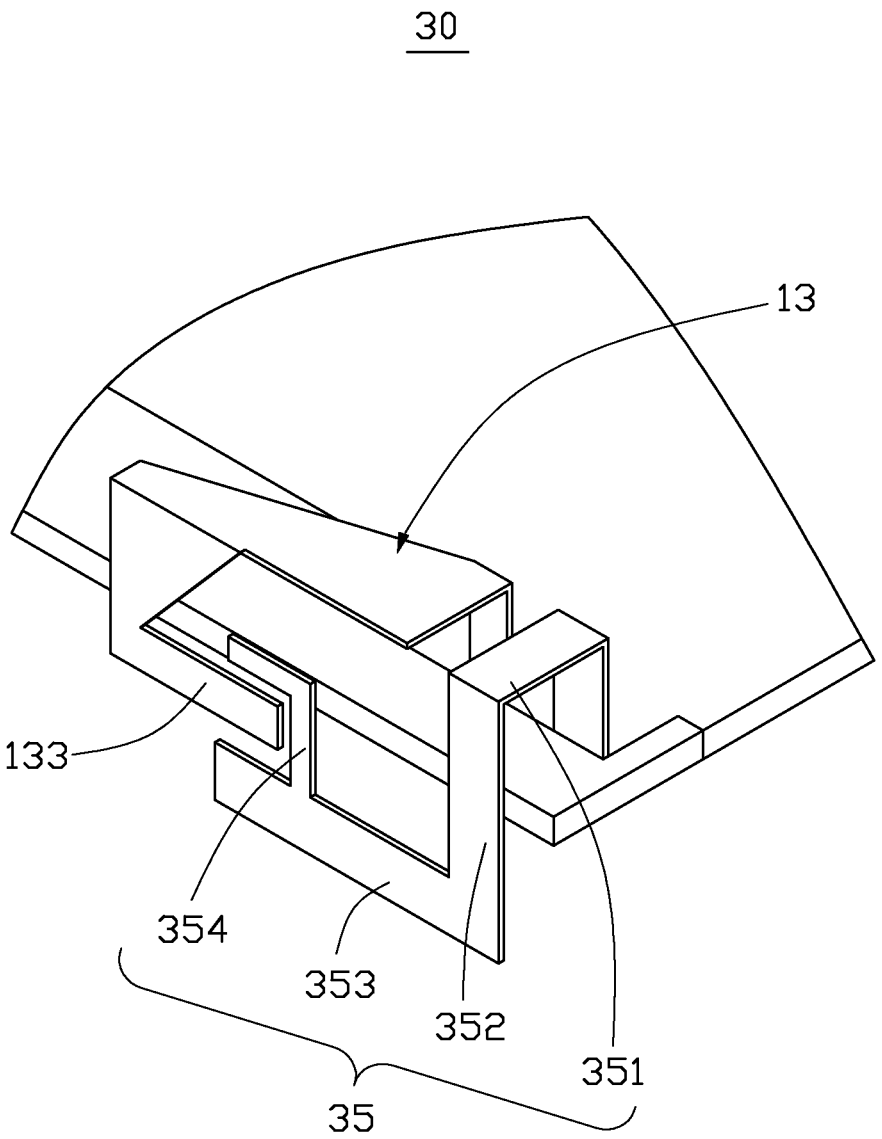
FIG. 4 is a schematic view of a third exemplary embodiment of a broadband antenna of the wireless communication device.

FIG. 4 illustrates a third exemplary embodiment of a broadband antenna 30 of the wireless communication device 100. A difference between the broadband antenna 30 and the broadband antenna 10 is that a resonating unit 35 replaces the resonating unit 15. The other structures of the broadband antenna 30 are substantially similar to those of the broadband antenna 10. In the third exemplary embodiment, the resonating unit 35 includes a first resonating arm 351, a second resonating arm 352, a third resonating arm 353, and a fourth resonating arm 354. The first resonating arm 351 and the second resonating arm 352 have a same shape and size as the first resonating arm 151 and second resonating arm 152 of the broadband antenna 10 of the first exemplary embodiment, respectively. The third resonating arm 353 substantially perpendicularly extends from the second resonating arm 352, and is substantially parallel to the third radiating portion 133. The fourth resonating arm 354 is substantially L-shaped, and extends from one edge of the third resonating arm 353. The fourth resonating arm 354 and a distal end portion of the third resonating arm 353 cooperatively define a space to receive a distal end portion of the third radiating portion 133.

Figure 5:
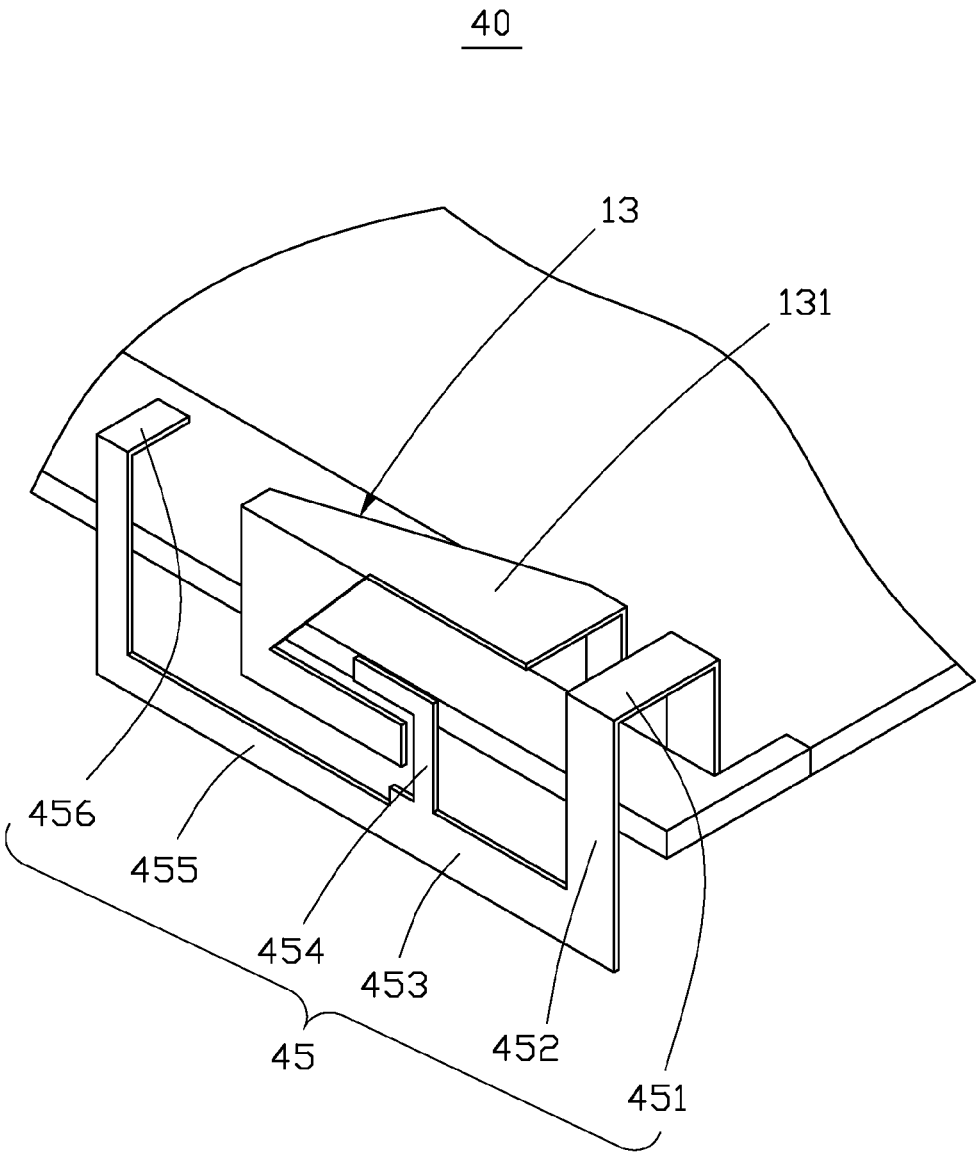
FIG. 5 is a schematic view of a fourth exemplary embodiment of a broadband antenna of the wireless communication device.

FIG. 5 illustrates a fourth exemplary embodiment of a broadband antenna 40 of the wireless communication device 100. The difference between the broadband antenna 40 and the broadband antenna 30 is that a resonating unit 45 replaces the resonating unit 35. In the fourth exemplary embodiment, the resonating unit 45 includes a first resonating arm 451, a second resonating arm 452, a third resonating arm 453, a fourth resonating arm 454, a fifth resonating arm 455, and a sixth resonating arm 456. The first resonating arm 451, the second resonating arm 452, and the fourth resonating arm 454 have a substantially same shape and size as the first resonating arm 351, the second resonating arm 352, and the fourth resonating arm 354 of the broadband antenna 30, respectively. The third resonating arm 453 of the broadband antenna 40 is a little shorter than the third resonating arm 353 of the broadband antenna 30. The fifth resonating arm 455 is substantially L-shaped and extends continuously from the third resonating arm 453. The sixth resonating arm 456 substantially perpendicularly extends from one end portion of the fifth resonating arm 455, and is substantially coplanar with the first resonating arm 451.

Figure 6:
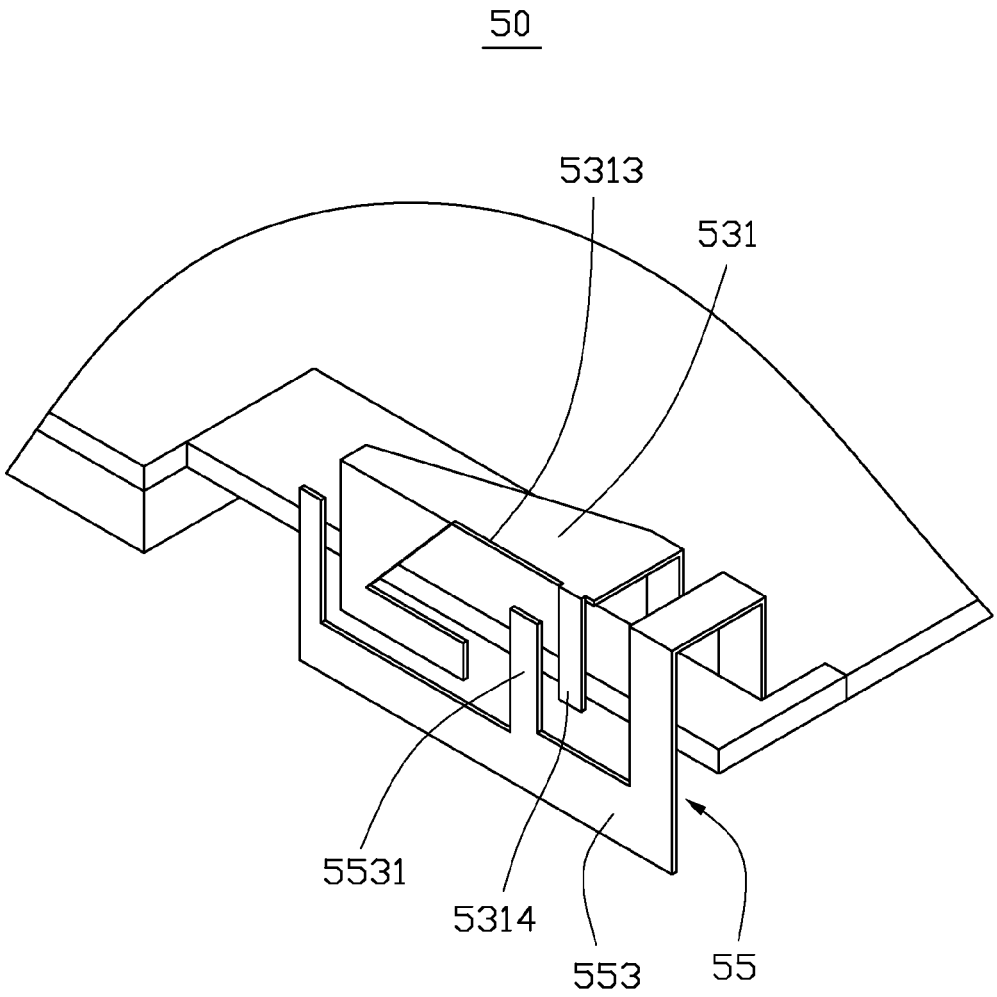
FIG. 6 is a schematic view of a fifth exemplary embodiment of a broadband antenna of the wireless communication device.

FIG. 6 illustrates a fifth exemplary embodiment of a broadband antenna 50 of the wireless communication device 100. The broadband antenna 50 differs from the broadband antenna 10 in that a resonating unit 55 replaces the resonating unit 45. The resonating unit 55 includes a first extending arm 5531, and a first radiation portion 531 of the broadband antenna 50 includes a second extending arm 5314. In the fifth exemplary embodiment, the first extending arm 5531 substantially perpendicularly extends from one edge of a third resonating arm 553 toward the first radiation portion 531. The second extending arm 5314 substantially perpendicularly extends from a third edge 5313 of the first radiation portion 531, and is substantially parallel to and spaced apart from the first extending arm 5531.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A broadband antenna, comprising:

a first feeding portion;

a second feeding portion;

a grounding portion;

a low band radiating unit connected to the first feeding portion, the low band radiating unit establishing a first current path to generate a low band frequency;

a high band radiating unit connected to the second feeding portion and spaced from the low band radiating unit, the high band radiating unit establishing a second current path to generate a first high band frequency; and a resonating unit connected to the grounding portion and spaced apart from the high band radiating unit, the resonating unit establishing a third current path to generate a second high band frequency, and resonate with the high band radiating unit to generate a third high band frequency;

wherein the low band radiating unit is a meander monopole antenna, and comprises a plurality of U-shaped radiators, a first connecting strip, and a plurality of second connecting strips; the radiators are positioned in a same plane and are connected in sequence by the second connecting strips; the first connecting strip connects between one of the radiators and the first feeding portion; the first connecting strip and the second connecting strips are positioned in a plane that is substantially perpendicular to the plane in which the radiators are positioned;

wherein the high band radiating unit comprises a first radiating portion, a second radiating portion, and a third radiating portion, the first radiating portion is a trapezoidal strip, the second radiating portion substantially perpendicularly extends from the first radiating portion, the third radiating portion substantially perpendicularly extends from an end of the second radiating portion opposite to the first radiating portion; the second radiating portion and the third radiating portion are positioned in a plane that is substantially perpendicular to a plane in which the first radiating portion is positioned;

wherein the resonating unit comprises a first resonating arm, a second resonating arm, a third resonating arm, and a fourth resonating arm, the first resonating arm is coplanar with the first radiating portion, the second resonating arm extends from the first resonating arm, the third resonating arm extends from the second resonating arm, the fourth resonating arm extends from the third resonating arm, the second, third and fourth resonating arms are coplanar with the second radiating portion.

2. The broadband antenna of claim 1, wherein the second feeding portion substantially perpendicularly extends from the first radiating portion opposite to the second radiating portion, and is positioned in a plane that is substantially perpendicular to the plane in which the first radiating portion is positioned.

3. The broadband antenna of claim 1, wherein the second resonating arm, the third resonating arm, and the fourth resonating arm together define a receiving space to receive the second radiating portion and the third radiating portion.

4. The broadband antenna of claim 3, wherein the resonating unit further comprises an extending arm substantially perpendicularly extending from one edge of the third resonating arm facing the first radiation portion.

5. The broadband antenna of claim 1, wherein the fourth resonating arm and a distal end of the third resonating arm together define a receiving space, to receive a distal end of the third radiating portion.

6. The broadband antenna of claim 5, wherein the resonating unit further comprises a fifth resonating arm and a sixth resonating arm, the fifth resonating arm is L shaped, and extends continuously from the third resonating arm; the sixth resonating arm substantially perpendicularly extends from one end of the fifth resonating arm, and is coplanar with the first resonating arm.

7. The broadband antenna of claim 1, further comprising an impedance matching circuit and an impedance matching switch structure connected to the first feeding portion, wherein the impedance matching switch structure comprises a main strip and a plurality of grounding strips spaced apart from each other and substantially perpendicularly connected to one edge of the main strip, one of the grounding strips is selected to be grounded.

8. The broadband antenna of claim 1, wherein the grounding portion and the second feeding portion are coplanar and parallel to each other.

9. A wireless communication device, comprising:

a printed circuit board (PCB);

a broadband antenna, comprising:

a first feeding portion coupled to the PCB;

a second feeding portion coupled to the PCB;

a grounding portion coupled to the PCB;

a low band radiating unit connected to the first feeding portion, the low band radiating unit establishing a first current path to generate a low band frequency;

a high band radiating unit connected to the second feeding portion and spaced apart from the low band radiating unit, the high band radiating unit establishing a second current path to generate a first high band frequency; and a resonating unit connected to the grounding portion and spaced apart from the high band radiating unit, the resonating unit establishing a third current path to generate a second high band frequency, and resonate with the high band radiating unit to generate a third high band frequency;

wherein the low band radiating unit is a meander monopole antenna, and comprises a plurality of U-shaped radiators, a first connecting strip, and a plurality of second connecting strips; the radiators are positioned in a same plane and are connected in sequence by the second connecting strips; the first connecting strip connects between one of the radiators and the first feeding portion; the first connecting strip and the second connecting strips are positioned in a plane that is substantially perpendicular to the plane in which the radiators are positioned;

wherein the high band radiating unit comprises a first radiating portion, a second radiating portion, and a third radiating portion, the first radiating portion is a trapezoidal strip, the second radiating portion substantially perpendicularly extends from the first radiating portion, the third radiating portion substantially perpendicularly extends from an end of the second radiating portion opposite to the first radiating portion; the second radiating portion and the third radiating portion are positioned in a plane that is substantially perpendicular to a plane in which the first radiating portion is positioned;

wherein the resonating unit comprises a first resonating arm, a second resonating arm, a third resonating arm, and a fourth resonating arm, the first resonating arm is coplanar with the first radiating portion, the second resonating arm extends from the first resonating arm, the third resonating arm extends from the second resonating arm, the fourth resonating arm extends from the third resonating arm, the second, third and fourth resonating arms are coplanar with the second radiating portion.

10. The wireless communication device of claim 9, wherein the second feeding portion substantially perpendicularly extends from the first radiating portion opposite to the second radiating portion, and is positioned in a plane that is substantially perpendicular to the plane in which the first radiating portion is positioned.

11. The wireless communication device of claim 9, wherein the second resonating arm, the third resonating arm, and the fourth resonating arm together define a receiving space to receive the second radiating portion and the third radiating portion.

12. The wireless communication device of claim 11, wherein the resonating unit further comprises an extending arm substantially perpendicularly extending from one edge of the third resonating arm facing the first radiation portion.

13. The wireless communication device of claim 9, wherein the fourth resonating arm and a distal end of the third resonating arm together define a receiving space, to receive a distal end of the third radiating portion.

14. The wireless communication device of claim 13, wherein the resonating unit further comprises a fifth resonating arm and a sixth resonating arm, the fifth resonating arm is L shaped, and extends continuously from the third resonating arm; the sixth resonating arm substantially perpendicularly extends from one end of the fifth resonating arm, and is coplanar with the first resonating arm.

15. The wireless communication device of claim 9, further comprising an impedance matching switch structure connected to the first feeding portion, wherein the impedance matching switch structure comprises a main strip and a plurality of grounding strips spaced apart from each other and substantially perpendicularly connected to one edge of the main strip, one of the grounding strips is selected to be grounded.

16. The wireless communication device of claim 9, wherein the grounding portion and the second feeding portion are coplanar and parallel to each other.

* * * * *